US005314150A

United States Patent [19]

Seop

[11] Patent Number: 5,314,150

[45] Date of Patent: May 24, 1994

[54] SUPPORT STAND FOR GOLF BAG

[76] Inventor: Maeng Seop, Hanyang Apt. 22-102, Songpa-Dong, Songpa-Ku, Seoul, Rep. of Korea

[21] Appl. No.: 16,759

[22] Filed: Feb. 11, 1993

[30] Foreign Application Priority Data

Aug. 4, 1992 [KR] Rep. of Korea ..... 14606/1992

[51] Int. Cl.[5] ..... A63B 55/00

[52] U.S. Cl. ..... 248/96; 248/688; 206/315.7

[58] Field of Search ..... 248/96, 688, 136, 293, 248/284; 206/315.7, 315.2, 315.3

[56] References Cited

U.S. PATENT DOCUMENTS

| | | | |
|---|---|---|---|
| 1,757,471 | 5/1930 | Platt | 248/96 |
| 2,324,439 | 7/1943 | Thommen | 248/96 |
| 3,195,844 | 7/1965 | Roepke | 248/96 |
| 3,432,130 | 3/1969 | Breedlove et al. | 248/96 |
| 3,787,017 | 1/1974 | Sauer | 206/315.7 X |
| 4,054,256 | 10/1977 | Buck, Jr. et al. | 248/688 X |
| 4,739,958 | 4/1988 | Sato | 248/688 X |
| 4,949,844 | 8/1990 | Yang | 248/96 X |
| 5,036,974 | 8/1991 | Ross, Jr. | 206/315.7 |

*Primary Examiner*—Karen J. Chotkowski
*Attorney, Agent, or Firm*—Schmeiser, Morelle & Watts

[57] ABSTRACT

A support stand for a golf bag comprising a stand body having a pair of upper pivot members at its upper portion and a pair of lower pivot members its lower portion, a pair of legs pivotally mounted at their upper ends to the upper pivot members, respectively, each of the legs having at its upper portion a slide member provided with a slide slot, and an actuating member operatively connected to the legs to pivot the legs between an extended position and a retracted position. The actuating member having a pair of upper bent portions received at their ends in the slide slots of slide members, respectively, a pair of middle pivot portions mounted pivotally separably to the lower pivot members, respectively, and a balance weight mounted to a lower end of the actuating member. The legs can be easily extended by the weight of an actuating lever upon positioning the bag at an upright position or an inclined position and automatically retracted by the weight of the actuating lever, upon carrying the bag, while the actuating lever is not actuated upon storing the bag.

7 Claims, 3 Drawing Sheets

SUPPORT STAND FOR GOLF BAG

BACKGROUND OF THE INVENTION

1. Field of the Invention

The present invention relates to golf bags, and more particularly to support stands for golf bags wherein a pair of legs are movable between their extended position and their retracted position.

2. Description of the Prior Art

Conventionally, there have been proposed various golf bags which have legs movable between their extended and retracted positions. An example of such golf bags is disclosed in U.S. Pat. No. 4,506,854. The golf bag disclosed in the patent includes a pair of legs attached to a golf bag-supporting frame, and an actuator member having an upper end hingably connected to the legs and a lower end movable along a guide such that when the stand is set on the ground, the weight of the bag causes the actuator member to slide upwardly within the guide and thereby the legs to extend. There is a convenient in use, in that legs are automatically extended when the golf bag is set on the ground. However, this construction of golf bag has a problem that the golf bag can not stand on stably, since legs are extended even when the golf bag is set on the ground for carrying or storage thereof. During the user carries the golf bag by gripping a handle of bag with his hand, legs is hung downwardly. As he walks, the legs swing upwardly and downwardly, thereby causing carrying of golf bag to be troublesome.

In U.S. Pat. Nos. 4,676,464 and 4,921,192, there have been disclosed other examples of golf bags with support stands.

The construction disclosed in U.S. Pat. No. 4,676,464 comprises a pair of legs pivotally mounted at the upper ends thereof on the upper portion of golf bag, a pair of shoulder pads connected at the upper end thereof to the uppermost ends of said legs, respectively, and a pair of clamps fixedly mounted to the lower ends of said shoulder pads and adapted to fit around and slide along the legs, respectively. As the shoulder pads are lifted for carrying the golf bag, the clamps slide upwardly along the legs, thereby causing the legs to be retracted. On the other hand, shoulder pads are free, the lower ends of the shoulder pads made of an elastic material such as a nylon codes are extended by virtue of their elasticity, so that the clamps slide and push the legs, thereby causing the legs to extend and function as a stand. As compared with the prior arts, this construction has improved convenience in use, because the legs are automatically retracted in carrying the golf bag and automatically extended in using or storage thereof.

However, this construction has inconvenience in storage, since even in storage, the legs are automatically extended. Moreover, to carry or store a golf bag under the condition of extending the legs causes the necessity of a large space, thereby resulting in a decrease in transportation efficiency. In order to avoid such problems, a support member of a special shape is required. However, such a requirement makes it impossible to apply the above-mentioned construction to general types of golf bags.

In the golf bag disclosed in U.S. Pat. No. 4,921,192, a front half portion of the base of the bag is formed inclinedly so that as the inclined base portion is brought into contact with the ground, a vertically extending actuating rod, which is disposed at the side of bag adjacent to the inclined base portion and is movable upwardly and downwardly, is lifted to extend legs. This construction also have the disadvantage that it can not be used in general types of golf bags, because of requiring the inclined base. Furthermore, this inclined base causes a disadvantage that the golf bag falls down easily, in that the ground contact area thereof is only a part of the bottom surface of the base. In the case that golf clubs are contained in the golf bag, it is difficult to maintain the golf bag at its upright position, because the heavy weights of golf clubs should be supported only by the horizontal surface of the base. As a result, the golf bag is naturally maintained at its inclined position where the inclined surface of the base is in contact with the ground and legs are maintained at their extended position. Consequently, a large storage space is needed, in that the legs are naturally maintained at their extended position, in storage under the condition that golf clubs are contained in the bag.

Another golf bag has been disclosed in the Korean Utility Model Application No. 90-2102 filed on Feb. 26, 1990 by the applicant. The golf bag comprises a L-shaped actuating member provided at the lower end of a vertical movable member operatively connected to support legs. As the L-shaped actuating member is lifted up and lowered down, the legs are extended and retracted. However, this construction has a disadvantage that a space between extended legs may be insufficient or excessive, depending on the ground condition. Furthermore, the L-shaped actuating member may be easily damaged or transformed. The damaged or transformed actuating member makes the overall support stand useless. There is also disadvantages of complicated construction and expensive manufacture cost.

SUMMARY OF THE INVENTION

Therefore, an object of the invention is to overcome the above-mentioned disadvantages encountered in the prior arts and to provide a support stand for a golf bag wherein legs can be easily extended by the weight of an actuating lever upon positioning the bag at an upright position or an inclined position and automatically retracted by the weight of the actuating lever, upon carrying the bag, while the actuating lever is not actuated upon storing the bag.

Another object of the invention is to provide a support stand for a golf bag having a simple construction and capable of being applied to general types of golf bags.

In accordance with the present invention, this object can be accomplished by providing a support stand for a golf bag comprising: a stand body attached to the golf bag and having a pair of upper pivot members at its upper portion and a pair of lower pivot members its lower portion; a pair of legs pivotally mounted at their upper ends to the upper pivot members, respectively, each of the legs having at its upper portion a slide member provided with a slide slot; and an actuating member operatively connected to the legs to pivot the legs between an extended position and a retracted position, the actuating member having a pair of upper bent portions received at their ends in the slide slots of slide members, respectively, a pair of middle pivot portions mounted pivotally separably to the lower pivot members, respectively, and a balance weight mounted to a lower end of the actuating member.

BRIEF DESCRIPTION OF THE DRAWINGS

In order that the present invention may be more fully understand, reference will now be made by way of example to the accompanying drawings, in which.

DETAILED DESCRIPTION OF THE PREFERRED EMBODIMENTS

Figure 2:
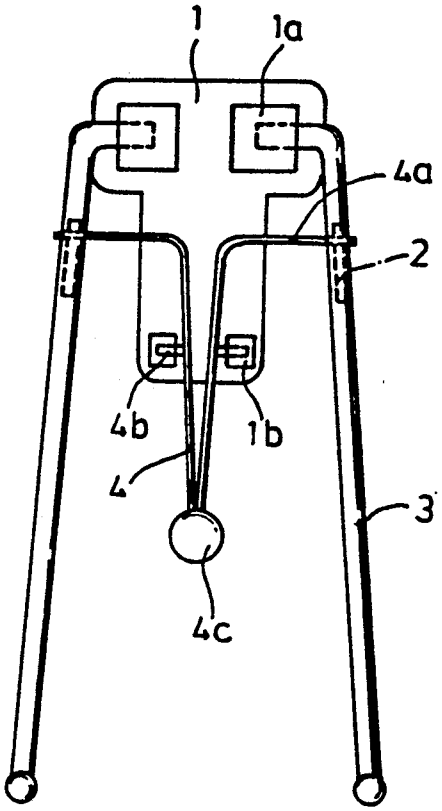
FIG. 2 is a front view of the support stand according to the present invention.
Figure 1:
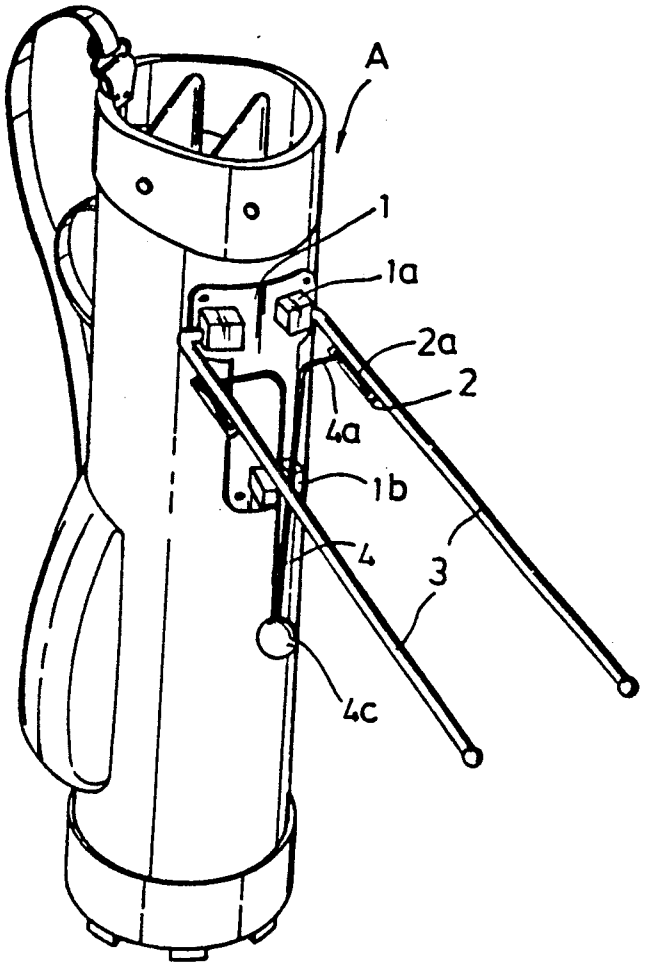
FIG. 1 is a perspective view of a golf bag with a support stand according to the present invention.
Figure 4:
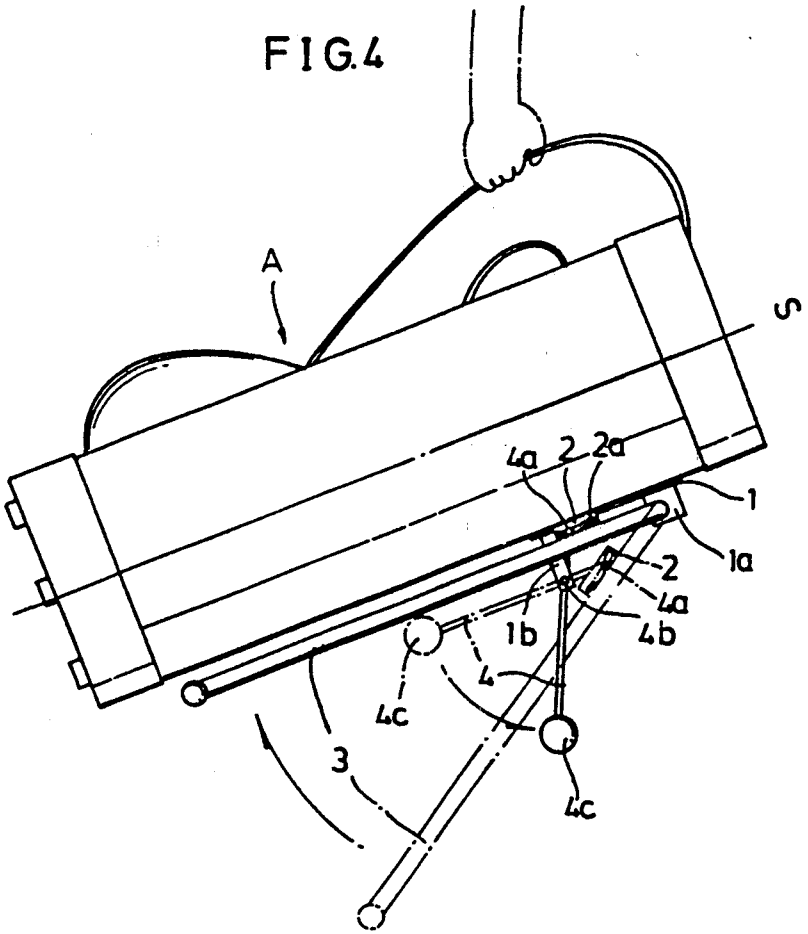
FIG. 4 is a side view of the golf bag which is at its carried state where legs are retracted.

Referring to FIG. 1, there is illustrated a golf bag with a support stand according to the present invention.

Figure 3:
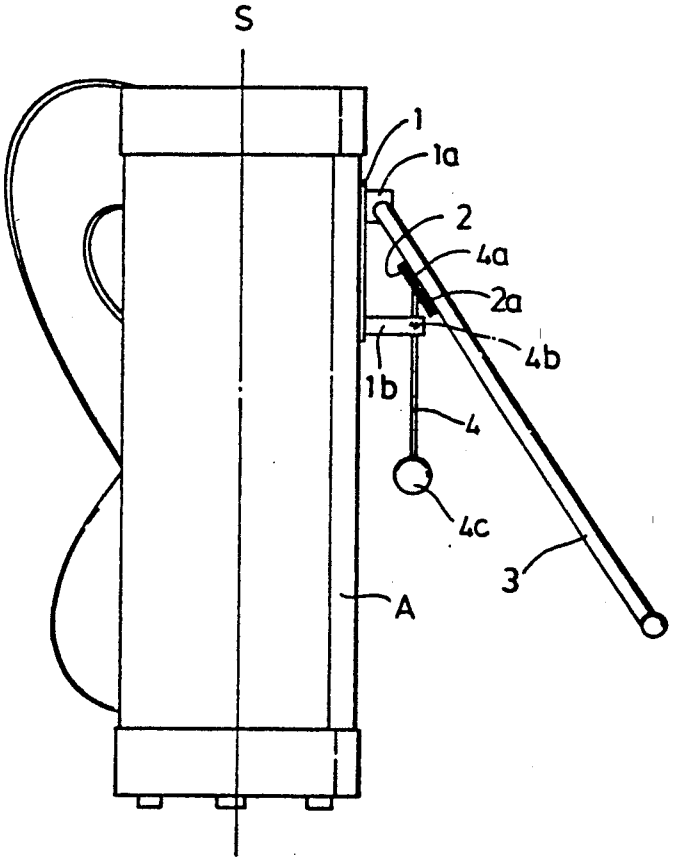
FIG. 3 is a side view of the golf bag which is at its upright position where legs are extended.

As shown in FIG. 1, the support stand of the present invention comprises a stand body having a pair of upper pivot members 1*a* at its upper portion and a pair of lower pivot members 1*b* at its lower portion and a pair of legs 3 pivotally mounted at their upper ends to the upper pivot members 1*a*, respectively. Each leg 3 has at its upper portion a slide member 2 provided with a slide slot 2*a*. An actuating member 4 is operatively connected to the legs 3, so as to pivot the legs 3 between an extended position and a retracted position. The actuating member 4 has a pair of upper bent portions 4*a* received at their ends in the slide slots 2*a* of slide members 2, respectively, and a pair of middle pivot portions 4*b* pivotally mounted to the lower pivot members 1*b*, respectively. The actuating member also has a balance weight 4*c* at its lower end. As shown in FIG. 3, the lower pivot members 1*b* are protruded from the stand body 1 beyond the upper pivot members 1*a*.

Now, the operation of the support stand with the above-mentioned construction according to the present invention will be described.

When the golf bag A is shifted from its inclined position to its upright position shown in FIG. 3, the actuating member 4 of the support stand pivots about the middle pivot portions 4*b* by virtue of the weight of the balance weight 4*c* so that it is arranged in parallel to the longitudinal axis S of the golf bag A. At this time, the upper bent portions 4*a* of the actuating member 4 received in the slide slots 2*a* of slide members 2 applies a pushing force to the legs 3 via the slide members 2, thereby causing the legs 3 to move pivotally to their extended position. The pivotal movement of legs 3 is carried out easily, since the distance between the balance weight 4*c* and the middle pivot portions 4*b* is considerably longer than the distance between the middle pivot portions 4*b* and the upper bent portions 4*a*.

Figure 6:
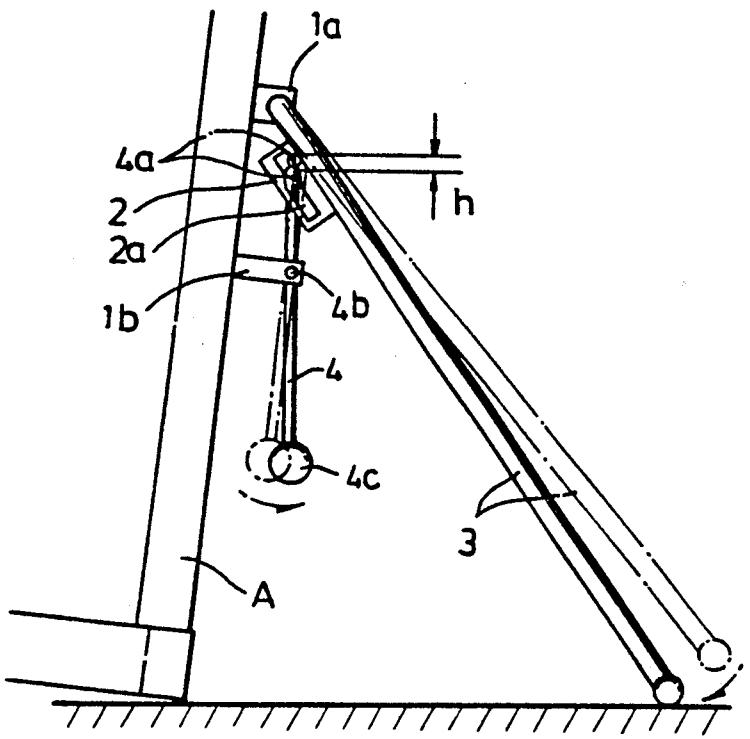
FIG. 6 is a schematic side view showing the shift of each upper bent portion of the actuating member carried out in the curved portion of slide slot of each corresponding slide member, when the golf bag is at its inclined position.

When the golf bag A is shifted again from the upright position where the legs 3 are at the extended position, to the inclined position, the balance weight 4*c* swings in anticlockwise through an angle corresponding to the inclined angle of the golf bag A, as shown in FIG. 6. Simultaneously, the upper bent portions 4*a* of the actuating member 4 slide downwardly along the slots 2*a* of slide members 2 by a distance h, thereby causing the legs 3 to pivot in clockwise and thus move slightly toward the retracted position. In order to such a movement of the legs 3, each slide slot 2*a* has at its upper portion a curved portion in which the upper bent portion 4*a* of each corresponding leg 3 is temporarily engaged upon shifting the golf bag A from its upright position toward its inclined position. With this construction, the extended angle of legs 3 at the upright position is still maintained upon shifting the golf bag A from the upright position toward the inclined position.

When the golf bag A is lifted up to be carried from one place to another place after its use, the balance weight 4*c* of the actuating member swings anticlockwise about the middle pivot portions 4*b*. Simultaneously, the upper bent portions 4*a* of the actuating member 4 pivot in anticlockwise against the force holding them at the curved portions of slide slots 2*a*. The pivotal movement of the upper bent portions 4*a* of actuating member 4 causes the legs 3 to move pivotally in clockwise to the retracted position. At this time, the upper bent portions 4*a* of actuating member 4 slide downwardly along the slide slots 2*a* of the slide member 2 attached to the legs 3, respectively. Thus, the legs 3 is maintained at the retracted position during when the golf bag A is carried.

Figure 5:
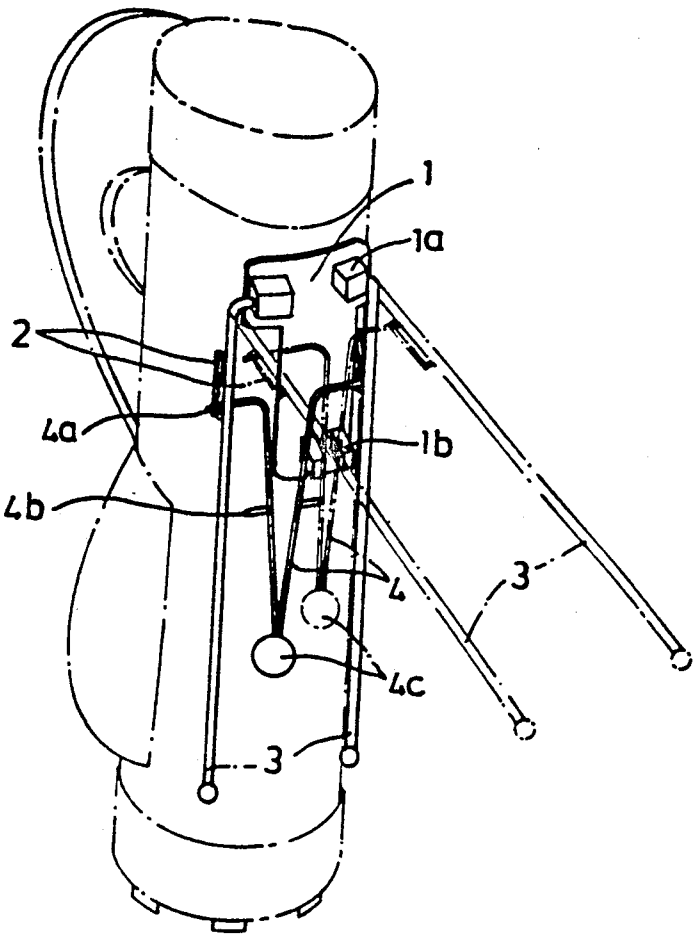
FIG. 5 is a perspective view of the golf bag which is at its upright position upon its storage, showing a condition that legs are separated from an actuating member of the support stand.

In accordance with the present invention, the middle pivot portions 4*b* of actuating member 4 can be separated from the lower pivot members 1*b*, respectively, so as to eliminate an inconvenience caused by the legs which move to the extended position by the actuating member during when the golf bag is stored at the upright position after its use. With this construction, as the middle pivot portions 4*b* of actuating member 4 are separated from the lower pivot members 1*b* after the use of golf bag A, as shown in FIG. 5, the movements of the legs between the extended position and the retracted position performed by the actuating member 4 is not achieved. Accordingly, the golf bag can be stored at a state that the legs are not extended.

As apparent from the above description, the present invention provides a golf bag with a support stand wherein legs can be easily extended by the weight of an actuating lever upon positioning the bag at an upright position or an inclined position and automatically retracted by the weight of the actuating lever, upon carrying the bag, while the actuating lever is not actuated upon storing the bag. The movements of the legs between the extended position and the retracted position are achieved by the support stand with a simple construction. The support stand of the present invention can be applied to general types of golf bags.

It must be understood that many alterations and modifications may be made by those having ordinary skill in the art to the structures disclosed herein without departing from the spirit and scope of the invention. Therefore, the presently illustrated embodiments have been shown only by way of example and should not be taken to limit the scope of the following claims.

What is claimed is:

1. A support stand for a golf bag comprising:

upper and lower pivot arrangements mounted on upper and lower side portions of the golf bag, respectively;

a pair of legs pivotally mounted at upper ends thereof to said upper pivot arrangement, each of said legs having a slotted slide member adjacent said upper end; and an actuating member for pivoting the legs between extended and retracted positions, the actuating member having a pair of upper portions which are slidably received within said slotted slide members, respectively, a pair of pivot elements each pivotally mounted to said lower pivot arrangement and a balance weight mounted to a lower end thereof;

wherein said balance weight is adapted to displace the upper portions of said actuating member within the slotted slide member of each leg, thereby pivoting the legs between extended and retracted positions.

2. The support stand according to claim 1, wherein each of said slotted slide members includes a curved upper slot portion.

3. The support stand according to claim 1, wherein said actuating member pivot elements are separable from said lower pivot arrangement.

4. A support stand for a golf bag comprising:

upper and lower pivot arrangements mounted on a side portion of said golf bag;

a pair of legs pivotally mounted to said upper pivot arrangement, each said leg having a slotted slide member proximate an upper portion thereof;

an actuating member for pivoting the legs between extended and retracted positions, said actuating member including an upper portion which is slidably received within the slotted slide member of each leg, a pivot member which is pivotally mounted to said lower pivot arrangement and a balance weight affixed to a lower portion thereof;

wherein said balance is adapted to displace the upper portion of said actuating member within the slotted slide member of each leg, thereby pivoting the legs between extended and retracted positions.

5. The support stand according to claim 4, wherein each of said slotted members includes a curved upper slot portion.

6. The support stand according to claim 4, wherein said pivot member is separable from said lower pivot arrangement.

7. A support stand for a golf bag comprising:

an actuating member including a balance weight mounted to a lower end thereof;

a pair of legs each including means for slidably receiving an upper portion of said actuating member therein; and means for pivotally securing the legs to said golf bag;

wherein said balance weight is adapted to displace the upper portion of said actuating member within said receiving means, thereby pivoting the legs between extended and retracted positions.

* * * * *